US007319207B2

(12) United States Patent
Campf et al.

(10) Patent No.: US 7,319,207 B2
(45) Date of Patent: Jan. 15, 2008

(54) PERSONNEL HEATING ASSEMBLY

(75) Inventors: Melvin F. Campf, Lake Oswego, OR (US); Jim Thorne, Portland, OR (US); Habib Homoyoun, Beaverton, OR (US); R. Wayne Fields, Brookings, OR (US)

(73) Assignee: ThermoGear, Inc., Lake Oswego, OR (US)

( * ) Notice: Subject to any disclaimer, the term of this patent is extended or adjusted under 35 U.S.C. 154(b) by 149 days.

(21) Appl. No.: 10/635,845

(22) Filed: Aug. 5, 2003

(65) Prior Publication Data

US 2005/0016982 A1 Jan. 27, 2005

Related U.S. Application Data

(60) Provisional application No. 60/401,006, filed on Aug. 5, 2002.

(51) Int. Cl.
*H05B 3/34* (2006.01)

(52) U.S. Cl. ..... 219/212; 219/211; 219/529; 607/96

(58) Field of Classification Search ..... 219/212, 219/528–529, 549, 510, 494, 211; 607/108, 607/94

See application file for complete search history.

(56) References Cited

U.S. PATENT DOCUMENTS 3,130,289 A * 4/1964 Katzman et al. ..... 219/479
3,443,066 A 5/1969 Weibel
3,668,367 A * 6/1972 Williams ..... 219/212
3,710,075 A * 1/1973 Jablonowski ..... 607/108
3,796,855 A * 3/1974 Brown et al. ..... 219/211
3,989,924 A 11/1976 Kurtzer
4,042,803 A * 8/1977 Bickford ..... 219/211
4,273,989 A * 6/1981 Hinton et al. ..... 219/211
4,279,255 A * 7/1981 Hoffman ..... 607/112
4,950,868 A 8/1990 Moss et al.
5,020,517 A * 6/1991 Foster et al. ..... 601/57
5,036,177 A * 7/1991 Pagliarini, Jr. ..... 219/212
5,138,138 A * 8/1992 Theilacker et al. ..... 219/528
5,750,962 A * 5/1998 Hyatt ..... 219/528
5,986,243 A * 11/1999 Campf ..... 219/529
6,331,695 B1 * 12/2001 West ..... 219/212
6,582,456 B1 * 6/2003 Hand et al. ..... 607/108
6,653,607 B2 * 11/2003 Ellis et al. ..... 219/528
6,770,848 B2 * 8/2004 Haas et al. ..... 219/212
6,840,955 B2 * 1/2005 Ein ..... 607/108
7,077,825 B1 * 7/2006 Stull ..... 604/113

FOREIGN PATENT DOCUMENTS

CA 1262927 * 11/1989

(Continued)

*Primary Examiner*—Tu Ba Hoang
*Assistant Examiner*—Vinod Patel
(74) *Attorney, Agent, or Firm*—Schwabe, Williamson & Wyatt, P.C.

(57) ABSTRACT

A heating assembly, is disclosed which includes a blanket portion and a control apparatus for electrically heating the blanket portion. The control apparatus generates direct current power of desired wave form to enable the assembly to be used for warming patients without interference of medical equipment as may be used in the process of a surgery. Alternate power sources include battery power and alternating current power transformed by a transformer into direct current power.

7 Claims, 5 Drawing Sheets

FOREIGN PATENT DOCUMENTS

| | | | |
|---|---|---|---|
| DE | 2413594 | * | 10/1975 |
| DE | 3433437 | * | 3/1986 |
| DE | 3800919 | * | 7/1989 |
| DE | 29910197 | * | 11/1999 |
| DE | 20202218 | * | 4/2002 |
| FR | 2577390 A1 | | 8/1986 |
| WO | 01/35878 | * | 5/2001 |

* cited by examiner

PERSONNEL HEATING ASSEMBLY

RELATED APPLICATION

This application is a non-provisional application claiming benefit under 35 U.S.C. § 119(e) of U.S. Provisional Application No. 60/401,006, filed Aug. 5, 2002.

BACKGROUND OF THE INVENTION

1. Field of the Invention

This invention relates to an electric blanket that operates on DC power and can accordingly be battery operated to enable users to operate the heating elements of the blanket where AC power is not available, e.g. golf cart or medical EMT use, or otherwise where AC power is not desirable, e.g., for warming patients in an environment where power cords or electromagnetic waves from alternating current sources may be detrimental.

2. Background Information

Battery powered electric blankets are not new, as illustrated in the commonly owned U.S. Pat. No. 5,986,243, the disclosure of which is incorporated herein by reference. Whereas the electric blanket of the '243 patent was primarily targeted as a stadium blanket, a secondary use that is referred to in the patent has been further developed as an aid for medical attendants, e.g., emergency personnel responding to automobile accidents and the like. The battery power, i.e., DC power, is controlled to emit only acceptable electromagnetic waves whereby the blanket electronics do not interfere with other medical equipment, e.g. monitoring a patient's vital signs.

Alternating current (AC) power sources or DC power sources with significant pulsations generate unacceptable electromagnetic waves and are accordingly not available for such use.

Following application of the blanket for emergency medical needs (as indicated in the '243 patent), it has been learned that there is a further need for such a blanket in a further category of the medical field. Patients scheduled for surgery, as an example, are taken from their assigned hospital room to a waiting room where they can wait for an hour or more. Then they are transported to the operating room where they are transferred onto an operating table. Following surgery, the patient is transported to a recovery room and back to the patient's assigned hospital room. Ambient temperatures and body thermal control reactions vary throughout this process which affects the patient and is undesirable. It is accordingly an object of the present invention to provide a heating blanket that can be utilized to maintain or, as desired, beneficially control a patient's body temperature throughout the preparation for surgery, the surgery and while in recovery or in other areas of the hospital where body temperature control is important.

BRIEF DESCRIPTION OF INVENTION

Desirable features of the heating assembly may include one or more of the following:

A desired portable blanket assembly for surgery and other medical needs, as explained above, that is equipped with sensors whereby the blanket is prevented from exceeding a particular temperature, e.g., 105 degrees Fahrenheit, and which is able to effect passive or active control of subject body temperature.

A battery and a transformer provide alternate power sources, the latter converting or transforming alternating current to direct current. The blanket is operated by direct current at a moderate electromagnetic wave length and low amplitude of variation as acceptable by FDA to avoid interference with electrical, medical monitoring equipment. Said blanket is operated from a battery power source when desired, e.g., in transition, and operated by the transformer via AC power to conserve the battery power, e.g., as when the patient is not in transition and is accessible to an AC power outlet.

A disposable overcover for said electric blanket is impervious to liquid and encases the blanket, including electrical connectors and conductors, to avoid contamination of the blanket and thereby rendering the blanket usable for other patients merely by replacement of the overcover.

Alternatively or additionally, such features may include a blanket having a control unit, including replaceable batteries, for extended life. Said control unit may further include multiple plug-in connections to enable supplemental power to a plurality of items, e.g., an electrically heated cap or cape in addition to or instead of an electric blanket.

Alternatively or additionally, such features may include a control unit that permits a readout of operator set subject temperature, a means to set the controlled temperature to an operator set value, and a means to derive a temperature measurement from a surface or core (e.g., esophageal; rectal) body location.

Alternatively or additionally, such features may include a control unit without a battery incorporated as part of the blanket or the blanket connector for connecting the blanket to either AC or DC power as described elsewhere.

Still further is the provision of a blanket construction that has a designated area replaced with a heat conductive non-metallic material to accommodate imaging equipment producing images of a designated portion of a patient's torso underlying that designated area.

For uses other than the described medical use, e.g., as a stadium blanket and/or other outdoor activities, a carrying case, in the form of a backpack, and the electrical blanket shaped to accommodate a seated person and in particular the upper portion of the blanket formed to fit over the shoulders and including hand warming pockets.

The portable blanket above having a redundant set of sensors, e.g., thermistor loops for closed loop temperature controlled feedback. A fault sensed by either of the thermistor loops will automatically activate an audio alarm.

The above and additional features are described in further detail in the following detailed description having reference to the accompanying drawings.

DESCRIPTION OF A PREFERRED EMBODIMENT OF THE PRESENT INVENTION

Figure 1:
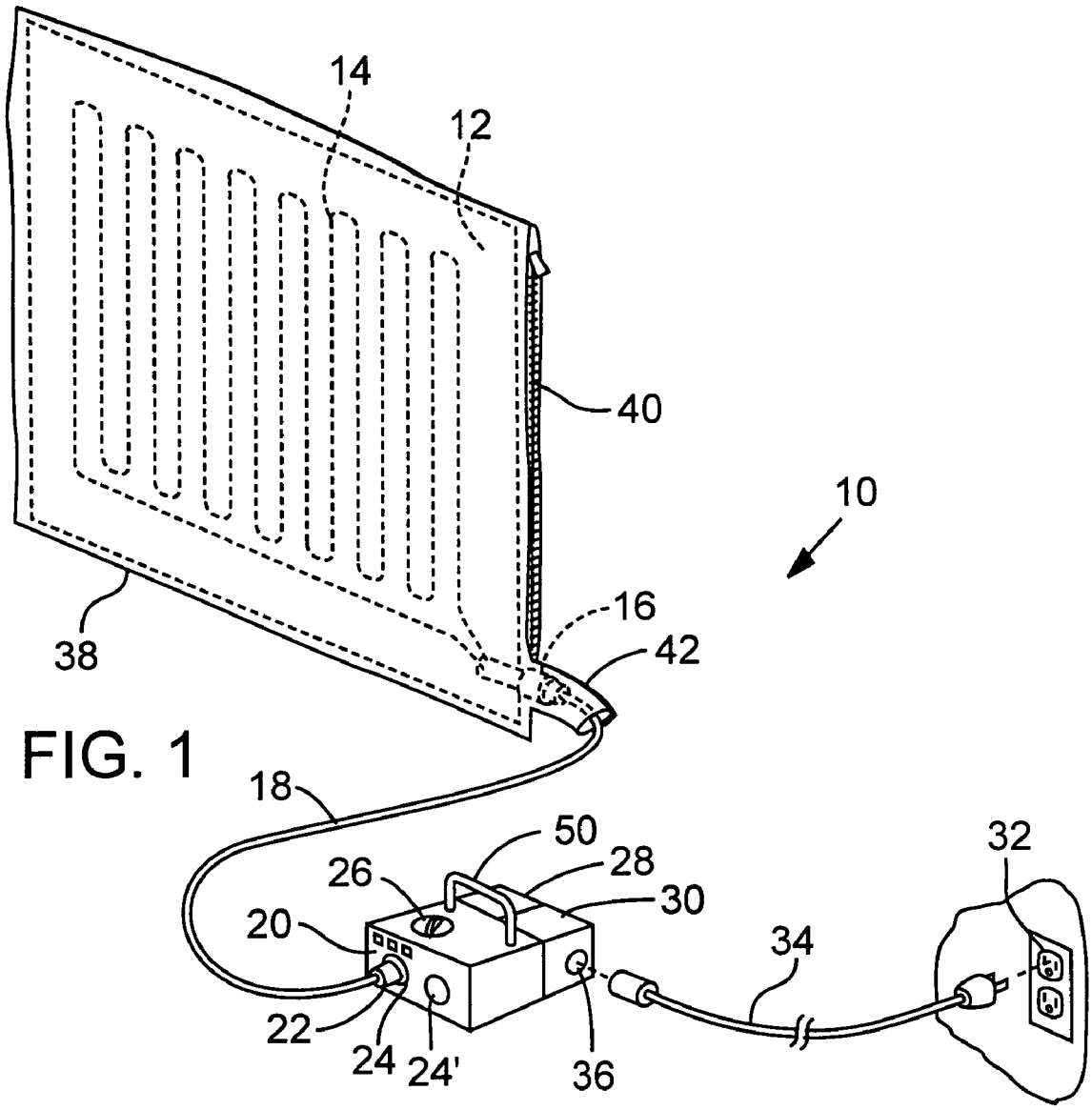
FIG. 1 is a schematic illustration of a personnel heating assembly in accordance with the present invention.
Figure 7:
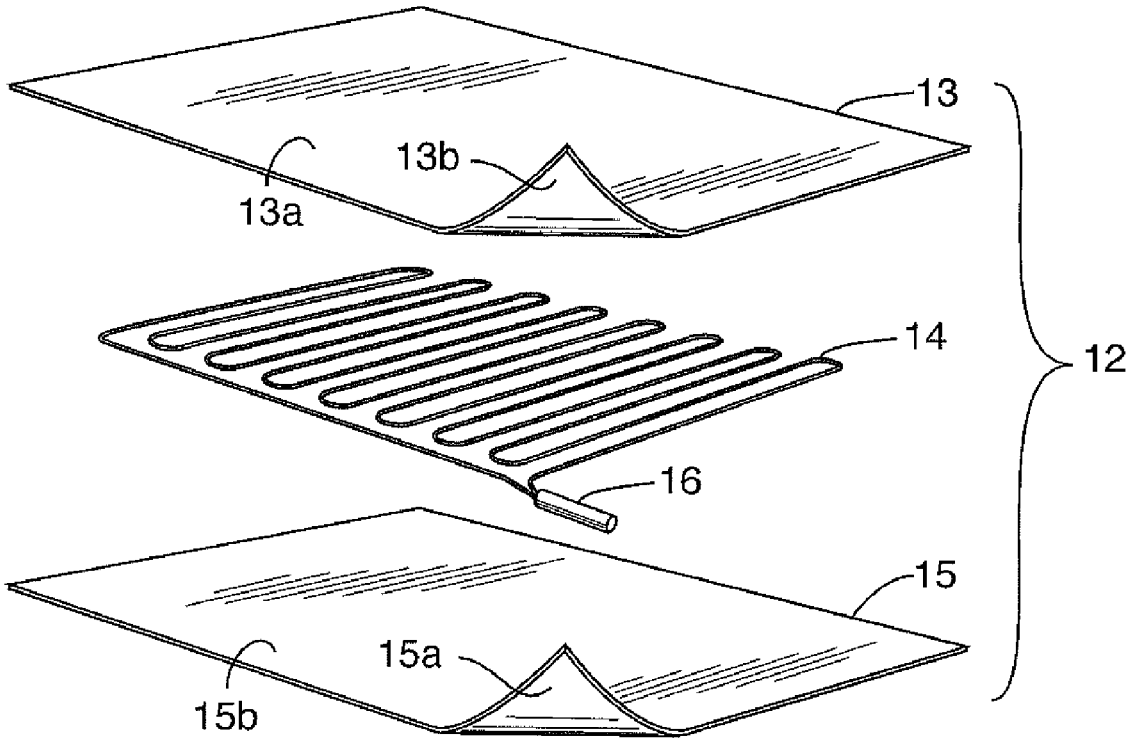
FIGS. 7 and 8 illustrate a blanket construction and schematic diagram for the blanket control in accordance with embodiments of the present invention.

FIG. 1 and FIG. 7 illustrate an electric personnel warming assembly 10 in accordance with the present invention. The assembly includes a multi-layered blanket or cover portion 12 having direct current (DC) "heating circuitry" 14 that is incorporated into the blanket. The blanket is desirably constructed of pliable cloth-like layers that include the desired insulation, heat reflection and heat conductive properties to ideally promote inwardly directed heat conveyance to a patient covered by the blanket. Note FIG. 7 which illustrates an outer layer 13 (having outer side 13*a* and inner side 13*b*) and an inner layer 15 (having inner side 15*b* and outer side 15*a*) with heating circuitry 14 sandwiched there between. Layer 13 is substantially heat reflective/non-conductive, and layer 15 is heat conductive. (See also commonly owned U.S. Pat. No. 5,986,243 incorporated herein by reference). A connector 16 and wire conductor 18 connect the heating circuitry 14 to a control apparatus 20 via a second connector 22 and plug-in 24.

Figure 8:
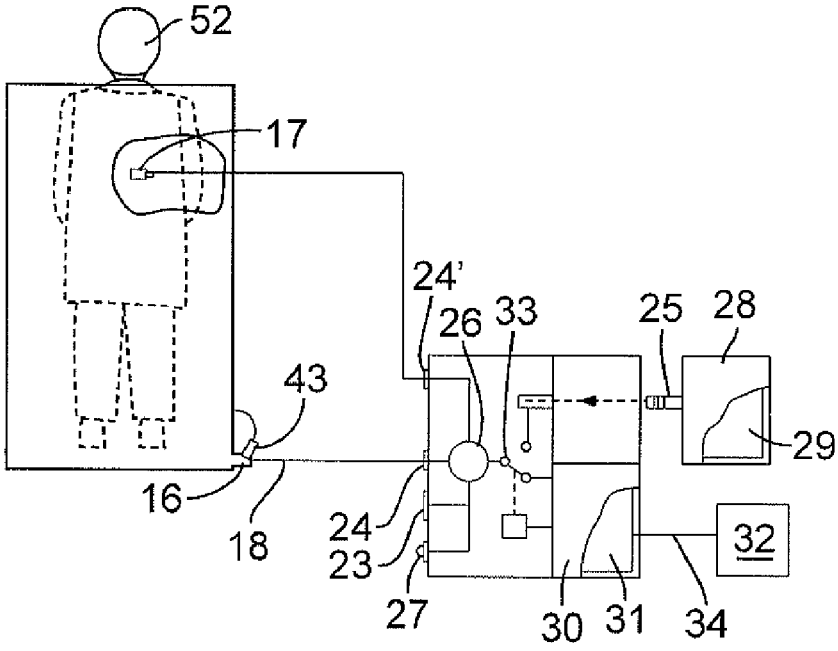

Reference is now made to FIGS. 7 and 8. The control unit or apparatus 20 includes multiple features. A control dial or pad 26 is usable by an operator to increase and decrease the energy input to circuitry 14 for increasing and decreasing heat conveyance to the blanket, and alternatively or additionally a sensor 17, e.g., an ear canal probe allows the operator to read patient body or core temperature or to set the target temperature for active regulation. Such core temperature regulation is accomplished e.g. using patient core temperature feedback from a suitable sensor such as a tympanic or rectal temperature sensor, the active feedback mode allowing patient core temperature to be operator set, maintained, and adjusted. A replaceable/rechargeable, e.g., plug-in battery (via connector 25), is contained in a section, e.g. 28, of the apparatus 20, and a transformer 31 is contained in a further section, e.g., 30, of the apparatus. The control apparatus 20 is otherwise equipped to provide a DC current flow to the blanket that is maintained at an acceptable electromagnetic waveform and pulsatile amplitude that will not interfere with monitoring equipment common to operating rooms, e.g., in a hospital. The specific features are not described or illustrated in detail, as these features, independently and not as combined herein, are well known to the industry and in some measure is disclosed in the aforementioned '243 patent.

Specifically not disclosed in the '243 patent is the transformer 31 provided, e.g., in section 30 of the control unit 20. The control apparatus 20 accordingly provides DC power to the blanket 12 via an alternating current (AC) source as typically provided from a wall socket 32 and connecting cord 34 connected into connector 36 located, e.g., in a side wall of the control apparatus. Alternative DC power can be provided by a replaceable/rechargeable battery 29 assembled into the control apparatus 20 as indicated at section 28.

An internal switch 33 within the control apparatus controls which of the power sources in sections 28 and 30 is connected to the blanket 12. By default, the switch 33 is connected to provide battery power and when the transformer 31 receives AC power, the switch 33 connects the transformer 30 and disconnects the battery 28 thereby conserving battery power. As desired, the AC connection may also be used to recharge the battery 29.

The arrangement as described is particularly beneficial to a use of the personnel heating assembly for surgical patients as will be described. In such use, it is particularly desirable to maintain the blanket 12 in a sterile environment. To accommodate this desire, an impervious overcover 38 is provided with a side edge 40 that is closable, e.g. by zipper, Velcro™, or double-sided tape, and further includes a tube portion 42 that extends over the connector 16 and cord 18 as may be desired. It may be further desirable to provide assurance that the assembly will not operate without the overcover. For example, at the location whereat the connector 16 is enclosed by tube portion 42, a snap 43 provided on the cover must be snapped onto the connector 16 before DC current flow can be provided to the blanket 12.

Figure 2:
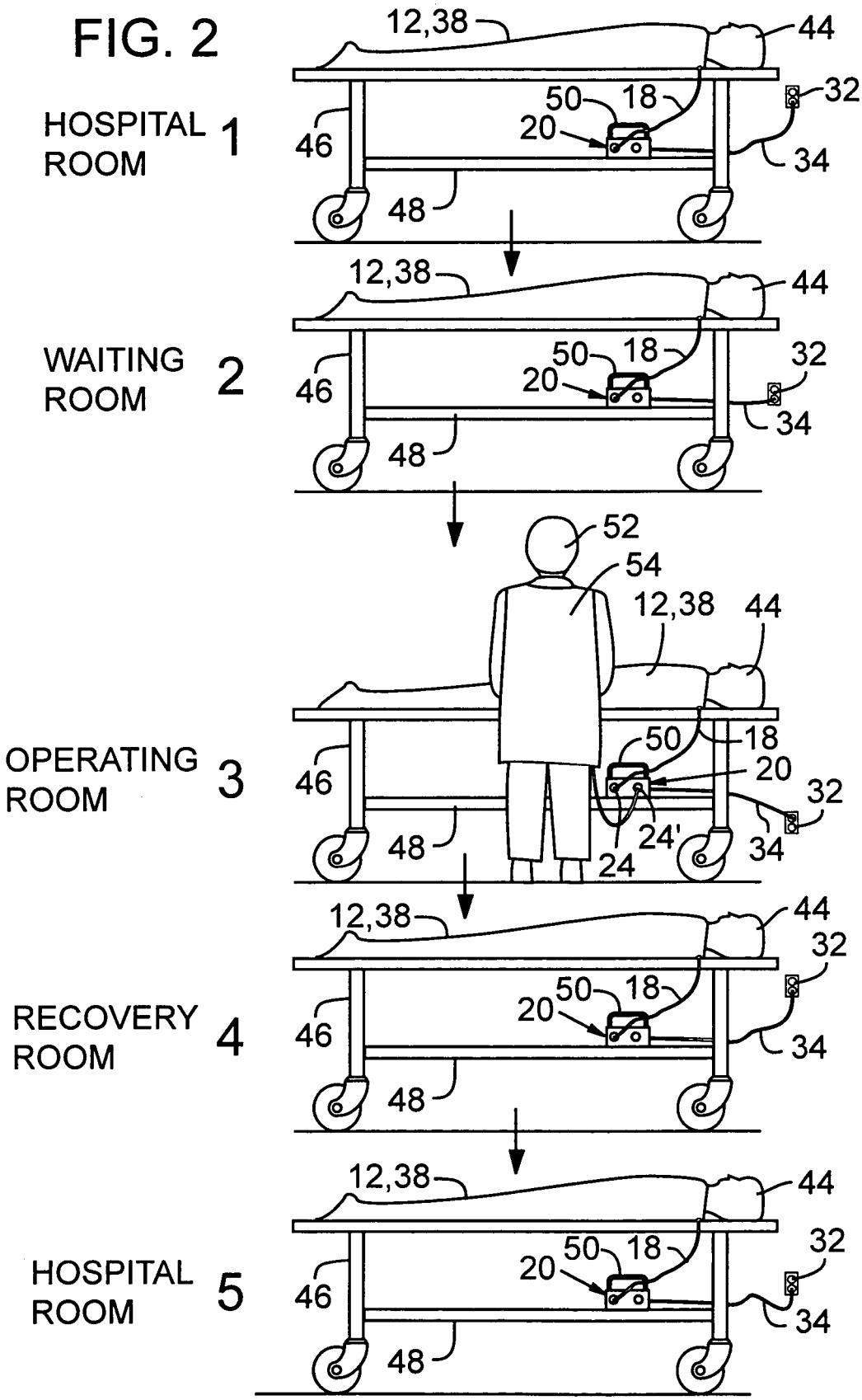
FIG. 2 is a sequence of pictorial views representing a flow chart of a process wherein the personnel heating assembly of FIG. 1 is utilized.

Reference is now made to the flow chart of FIG. 2. There are numerous scenarios that can occur as concerns hospital or field type use of the invention and the following description is intended to describe but one of those scenarios.

At stage or step 1, patient 44 is presumed to have been transferred from a conventional hospital bed to a hospital gurney 46. The gurney is provided with a storage shelf 48 and the control apparatus 20 is placed on the shelf 48 or hung from a built-in rail hook as may be facilitated by handle 50 provided on the apparatus (see FIG. 1). A blanket 12 provided with an overcover 38 is placed over the patient 44 and via conductor 18 is connected to the control apparatus. The dial or pad 26 is set to a desired setting (see FIG. 1) or specific temperature and the blanket is powered by the DC battery to produce a desired temperature for the patient.

The patient is wheeled from his/her hospital room to a waiting room (FIG. 2). While in the waiting room, the attendants have a choice of either leaving the blanket connected to the battery or simply locating the gurney convenient to a plug-in 32 and plugging in cord 34 as a means of conserving battery power.

When the operating room is ready, the cord 34 (if connected to plug-in 32) is disconnected and the patient is wheeled to the operating room (Step 3).

Obviously, again there is a choice of connecting the blanket to AC power and if the operation is expected to be lengthy, such connection is deemed to be desirable. Further, it is here noted that the control apparatus 20 is provided with multiple plug-ins 24 and in the illustrated embodiment a second plug-ins 24' is illustrated in FIG. 1. Whereas the operating room temperature is intentionally maintained at a lower than comfortable temperature (to combat the likelihood of infections), the physician 52, (including surgeons, anesthesiologists, etc.), as indicated in FIG. 2, step 3, may decide to be fitted with an electrically heated shawl or cape 54 and plugged into the further connector 24' (FIG. 1). Whereas the gurney 46 is illustrated also as the operating table in step 3, it will be appreciated that the patient, blanket and control apparatus may be transferred to a different, e.g., a conventional operating table at this step.

Step 4 illustrates the patient residing in a recovery room which may be extensive in time and again it is considered desirable as an alternative to plug into an AC outlet. Note that the batteries can be replaced or recharged when depleted.

Step 5 is indicative of the trip back to the patient's assigned hospital room.

Throughout the procedure as described, the typical procedure is to subject the patient to varied applied temperatures. Even though much or even most of the time in this procedure the patient may not be awake, body temperature problems are potentially detrimental and it is considered desirable in any event to maintain or beneficially control body temperature throughout the process. This can be achieved using the personnel heating assembly of the present invention.

Whereas the above description is believed to provide a unique solution to a heretofore unresolved and undesired problem, i.e., control of patent temperature, other advantages have further improved on the above stated invention.

Figure 3:
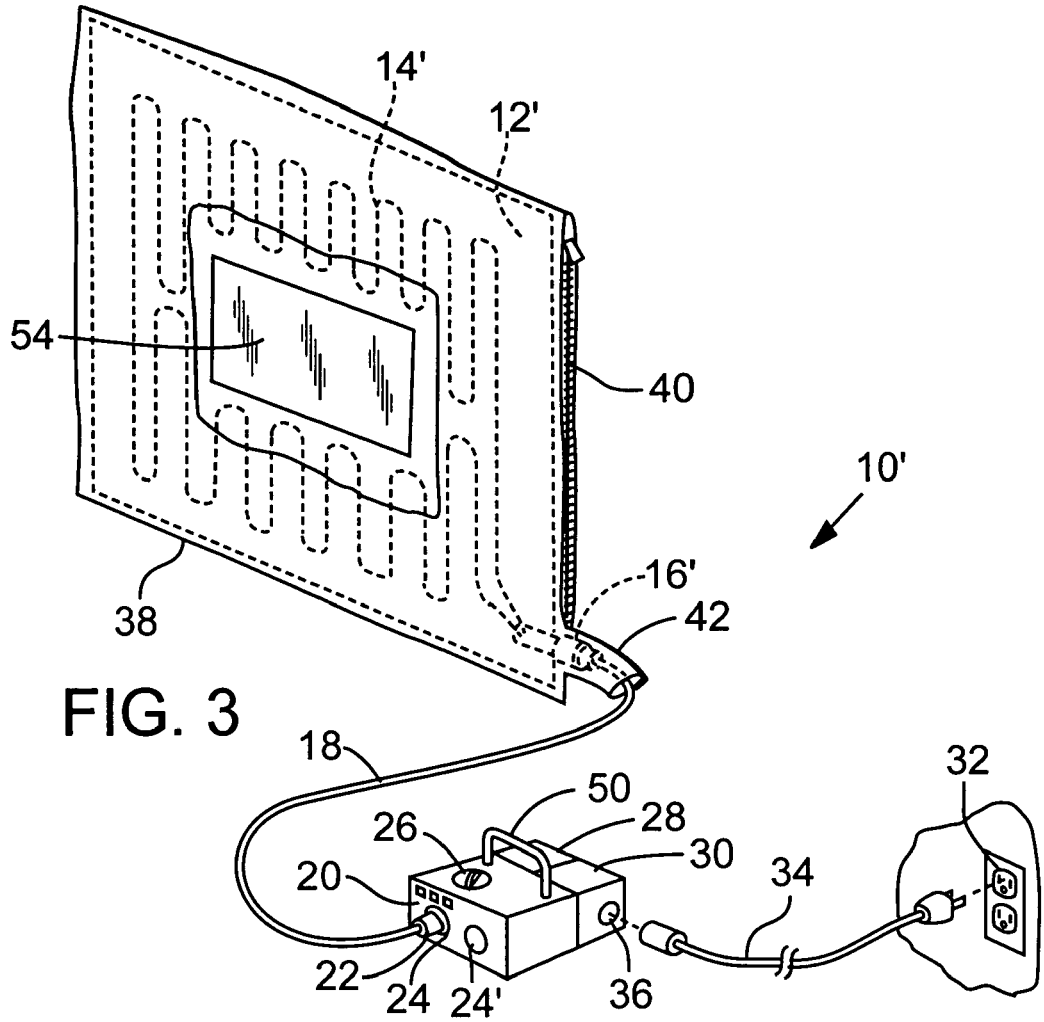
FIG. 3 is a variation of the heating blanket of FIG. 1.

In certain cases, the "operation" performed on a patient is the development of imagery as an x-ray or MRI imagery or even the application of a laser beam treatment. Referring to FIG. 3 of the drawings, the blanket 12' can be designed to have a designated center portion of the circuitry 14' replaced with a heat conductive non-metal material 54, e.g., electro-conductive textile product. This material is x-ray radioluscent and can be used in such situations as intravenous heart surgery where continuous viewing of the operation is required by the surgeon, while the patent is being kept warm to prevent shock or hypothermia.

Figure 4:
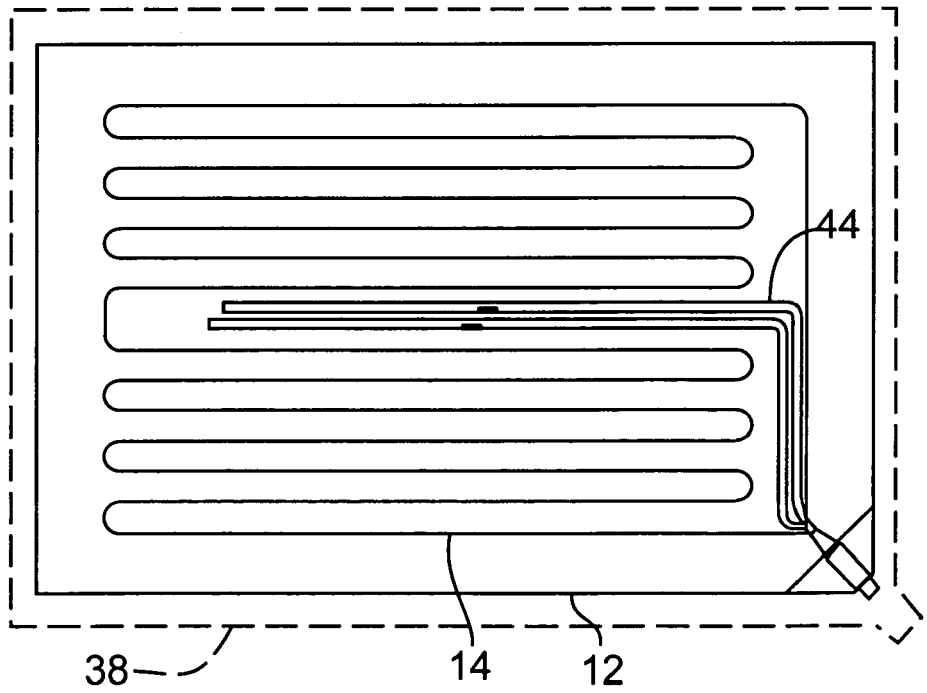
FIG. 4 is a further variation of the heating blanket of FIG. 1.

A further feature that may be added to the assembly is a fail safe circuit as illustrated in FIG. 4. Incorporated into the heating circuitry 14 of the cover is a redundant set of sensors 44 (thermistor) for closed loop temperature control feedback. These redundant temperature control sensors are located down the middle of the heated cover on two separate wire loops. A fault sensed by either thermistor loop will automatically activate an audio alarm 23, as well as light a fault LED 27 provided on the operating face of the control unit. It may additionally be considered desirable to provide an alternative placement of the control circuitry, i.e., within or on the blanket or as part of the blanket connector rather than in the control unit or apparatus, e.g., to reduce cabling and simplify circuitry.

Figure 5:
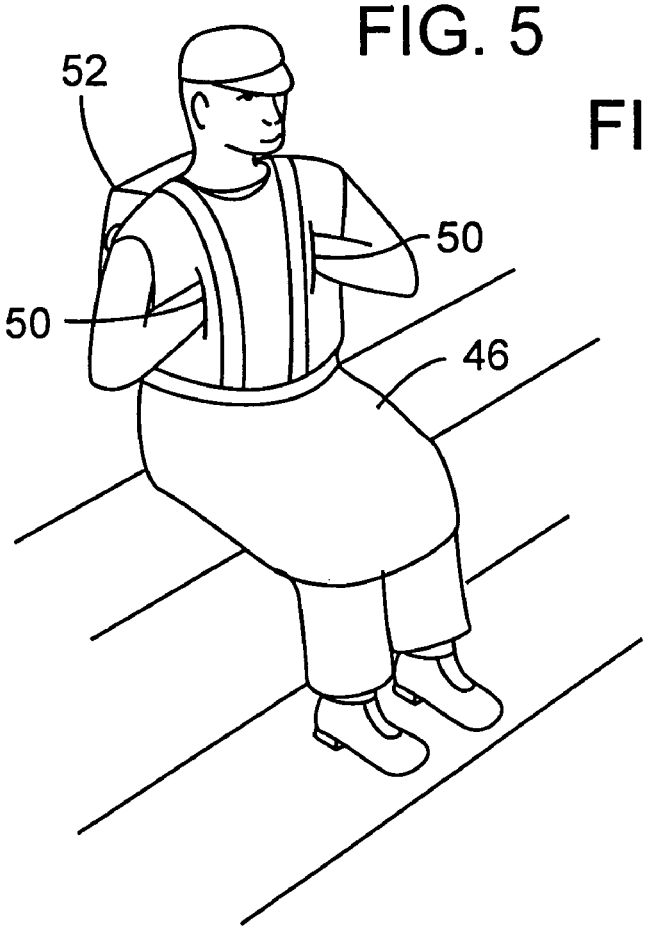
FIGS. 5 and 6 illustrate a further embodiment of the invention.

The reader will appreciate that a number of the above features may be incorporated into an alternate personnel heating assembly designed for use, e.g. for spectators at outdoor sporting events. The use of plug-in replaceable batteries will extend the use of the blanket, e.g., when watching a long parade or sitting through a plurality of outdoor events, e.g., a double header. It is also considered desirable to provide an alternative carrier for the assembly, e.g., a backpack 52 as illustrated in FIG. 5.

Figure 6:
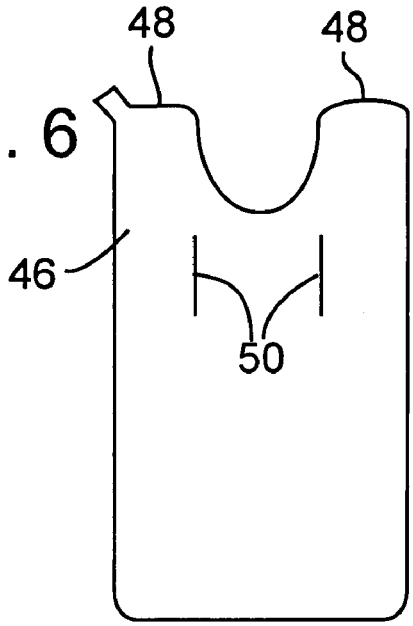

Still further is a modified shape of the blanket. FIGS. 5 and 6 illustrate a blanket 46, the shape of which is shown in FIG. 6 and as being worn by a spectator in FIG. 5. The blanket 46 is shaped at the top edge as shown to provide side portions 48 that fit over the wearer's' shoulders (which may be weighted to hold them in place) with pockets 50 that both warm the wearer's hands and also provide a convenient means to hold the blanket in place over the shoulders. Whereas the backpack 52 is worn by the spectator in FIG. 5, it may be considered more comfortable to place the backpack (with control apparatus) under the seat or alongside the spectator.

Many other modifications, variations and improvements will become apparent upon reflection of the many occasions when extra heat is desirable. Accordingly, the scope of the invention is not limited to the disclosure herein provided and instead is to be broadly interpreted as permitted by the common understanding of the terms encompassed in the claims appended hereto.

What is claimed is:

1. A personnel heating apparatus comprising:

a portable assembly including a blanket portion and a control apparatus;

said blanket portion having an outer blanket side and an inner blanket side and including pliable cloth-like layers, said layers cooperatively provided with insulation, heat reflection and heat conducting properties inducing downwardly and inwardly directed heat conveyance to a patient with the blanket portion draped over the top and along the sides of a torso and limbs of the patient in a lying down position;

an electrically actuated heating circuit provided in the pliable blanket portion among the layers and responsive to direct current electrical input for generating heat;

said control apparatus including a portable carrier, an electrical control circuitry contained in the carrier, and a direct current emitting battery contained in the carrier and connected to the control circuitry and providing direct current electrical power to the control circuitry, a conductor and connectors connecting the blanket portion to the control circuitry, and said control apparatus including a core temperature sensor for sensing the core temperature of said personnel and thereby enabling such personnel's core temperature to be set, maintained and adjusted, said control apparatus including controls controlling emission and adjusting the cyclic or irregular waveform of direct current electrical power to the blanket portion;

a transformer in said carrier for converting alternating current to direct current, said direct current from said transformer electrically connected to said electrical control circuitry for alternately providing direct current power to said circuitry and to said blanket portion, an alternating current input connector provided for said transformer and connectable to an alternating current plug-in, and a switch operative to connect the battery to the control circuitry when alternating current is not available to the transformer and to connect the transformer to the control circuitry when alternating current is available to the transformer; and said portable assembly including blanket portion and control apparatus having core temperature sensing, configured to provide continuing controlled heating of a patient being transported through sequential stages of medical care treatment.

2. An electric personnel heating assembly as defined in claim 1 wherein a replaceable and/or disposable outer cover encases the blanket portion and exposed connector of the blanket portion to prevent fluid contamination of the blanket portion and connector.

3. An electrical personnel heating assembly as defined in claim 2 wherein said blanket portion, carrier and electrical conductor therebetween are cooperatively configured to permit continuous warming of personnel when transported between locations requiring alternative coupling of the blanket portion as between the battery and the transformer when powered by an alternating current power source.

4. An electrical personnel heating assembly as defined in claim 1 wherein the battery is a replaceable plug-in battery enabling immediate substitution of the battery with a replacement plug-in battery.

5. An electrical personnel heating assembly as defined in claim 1 wherein the blanket portion is provided with a separate thermistor circuitry connected to an alarm, said thermistor circuitry responsive to a determined maximum temperature, for actuating the alarm to warn attendants of the temperature breaching said maximum temperature and/or interrupting electrical power to the heating circuit.

6. An electrical personnel heating assembly as defined in claim 1 wherein a microprocessor is provided for the control unit and connected to the control circuitry to regulate electrical power and thus heat intensity to the blanket portion.

7. An electrical personnel heating assembly as defined in claim 1 wherein the heating circuit comprises conductive wires, a designated area of the blanket portion provided for radiolucentcy penetration and said heating circuit configured to avoid the designated area, and a heat conductive non-metallic material provided for the designated area for conduction of heat but without interference of wave generating treatment equipment.

* * * * *